US007967633B2

(12) United States Patent
Chen et al.

(10) Patent No.: US 7,967,633 B2
(45) Date of Patent: Jun. 28, 2011

(54) CABLE CONNECTOR TERMINAL MODULE AND METHOD FOR MAKING THE SAME

(75) Inventors: Wu-Kuang Chen, Taipei Hsien (TW); Hsiaw-Chiang Chen, Taipei Hsien (TW); Min-Qiang Zhang, Shenzhen (CN); Chang-Hua Liao, Shenzhen (CN); Guo-Zhong Liu, Shenzhen (CN); Yong-Liang Chen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/899,725

(22) Filed: Oct. 7, 2010

(65) Prior Publication Data

US 2011/0023299 A1 Feb. 3, 2011

Related U.S. Application Data

(62) Division of application No. 12/238,393, filed on Sep. 25, 2008, now Pat. No. 7,824,217.

(30) Foreign Application Priority Data

Jun. 4, 2008 (CN) ..... 2008 1 0301962

(51) Int. Cl.
*H01R 9/05* (2006.01)

(52) U.S. Cl. ..... 439/580

(58) Field of Classification Search ..... 439/580, 439/578, 585, 675, 607.51, 607.58, 83, 278, 439/620; 29/883, 825, 857, 858, 874, 876
See application file for complete search history.

(56) References Cited

U.S. PATENT DOCUMENTS

| | | | | |
|---|---|---|---|---|
| 4,981,445 | A * | 1/1991 | Bacher et al. | 439/578 |
| 5,085,594 | A * | 2/1992 | Kaelin | 439/427 |
| 5,676,565 | A * | 10/1997 | Vagnoni | 439/580 |
| 2002/0193009 | A1 * | 12/2002 | Reed | 439/684 |
| 2004/0219835 | A1 * | 11/2004 | Vielhaber et al. | 439/585 |
| 2005/0176265 | A1 * | 8/2005 | Jacobs | 439/35 |

FOREIGN PATENT DOCUMENTS

| | | |
|---|---|---|
| CN | 2681401 Y | 2/2005 |
| CN | 1922769 A | 2/2007 |

* cited by examiner

*Primary Examiner* — T C Patel
*Assistant Examiner* — Harshad C Patel
(74) *Attorney, Agent, or Firm* — Clifford O. Chi

(57) ABSTRACT

A method for making a terminal module includes providing a first terminal and a second terminal positioned in the first terminal, forming an insulator between the first terminal and the second terminal, and forming a latching flange on an outer surface of the first terminal. The latching flange forms at least one resisting surface.

5 Claims, 3 Drawing Sheets

CABLE CONNECTOR TERMINAL MODULE AND METHOD FOR MAKING THE SAME

CROSS-REFERENCE TO RELATED APPLICATIONS

The present application is a divisional application of U.S. patent application Ser. No. 12/238,393, filed on Sep. 25, 2008, which claims foreign priority based on Chinese Patent application No. 200810301962.5, filed in China on Jun. 4, 2008.

BACKGROUND

1. Field of the Invention

The present disclosure relates to a terminal module, and more particularly to a terminal module used in a cable connector and a method for making the same.

2. Discussion of the Related Art

Electronic devices, such as cell phones, notebooks, personal digital assistants, and so on, have become widely used in recent years. Generally, these electronic devices are configured to have rechargeable batteries. Thus, a cable connector is provided to electrically connect a power source to an electronic device, such that the power source is able to recharge the battery in the electronic device.

Generally, a cable connector includes a housing, a status indicator, a terminal module, and a printed circuit board. The printed circuit board is disposed in the housing. The terminal module and the status indicator are electrically connected to the printed circuit board. Generally, a method of manufacturing the cable connector includes the following steps. Firstly, make an insulative housing. Secondly, a status indicator, a terminal module, and a printed circuit board are positioned in the housing, with the terminal module and the status indicator electrically connected to the printed circuit board. However, the terminal module is easily detached from the printed circuit board or rotated relative to the printed circuit board, thereby damaging the cable connector.

What is needed, therefore, is a new terminal module of a cable connector that overcomes the above mentioned disadvantages.

SUMMARY

A terminal module, configured for engaging in a housing of a cable connector, the housing defining a latching groove, and the latching groove forming at least one resisting surface, the terminal module including a first terminal, a second terminal positioned in the first terminal, an insulator positioned between the first terminal and the second terminal for insulating the first and second terminals from each other; and a latching flange disposed on an outer surface of the first terminal for engaging in the latching groove of the housing, wherein the latching flange forms at least one resisting surface corresponding to the at least one resisting surface of the latching groove.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present terminal module of a cable connector. Moreover, in the drawings, like reference numerals designate corresponding parts throughout the several views.

DETAILED DESCRIPTION

Figure 1:
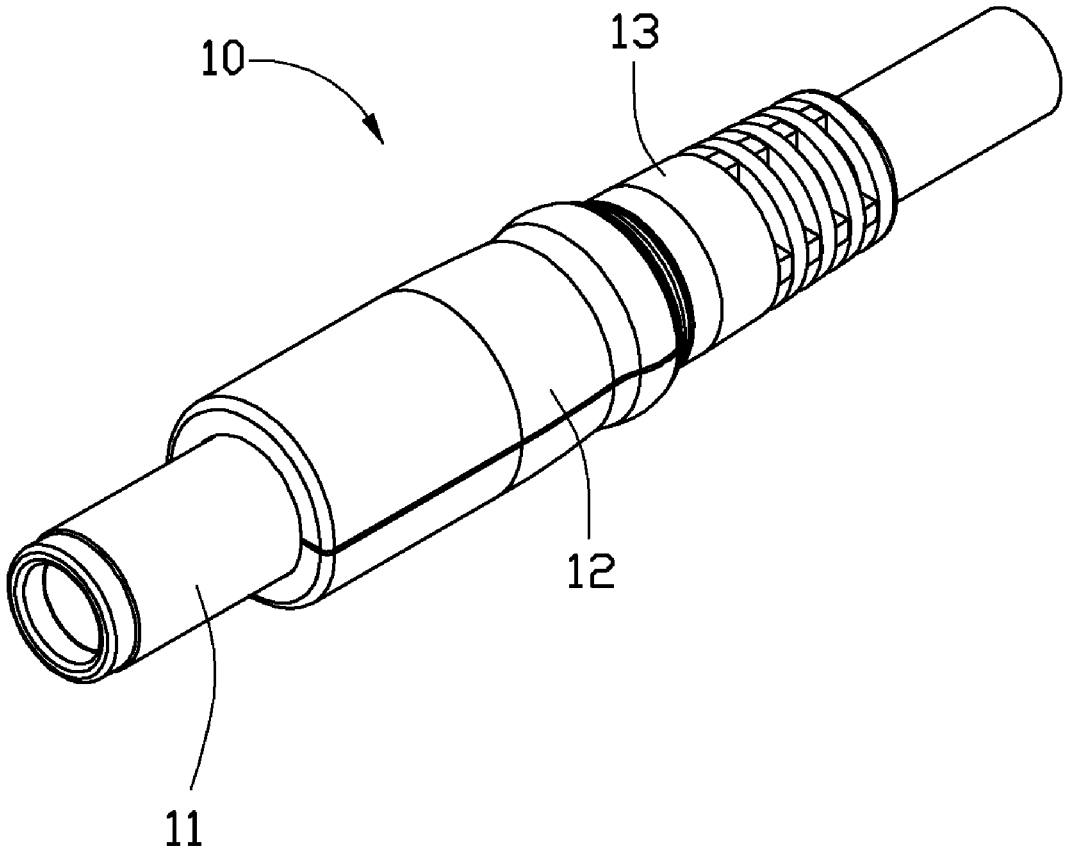
FIG. 1 is an isometric view of a cable connector in accordance with an exemplary embodiment of the present disclosure.

Referring to FIG. 1, a cable connector 10 of the present disclosure includes a terminal module 11 and a housing 12. The cable connector 10 is electrically connected to a cable 13.

Figure 2:
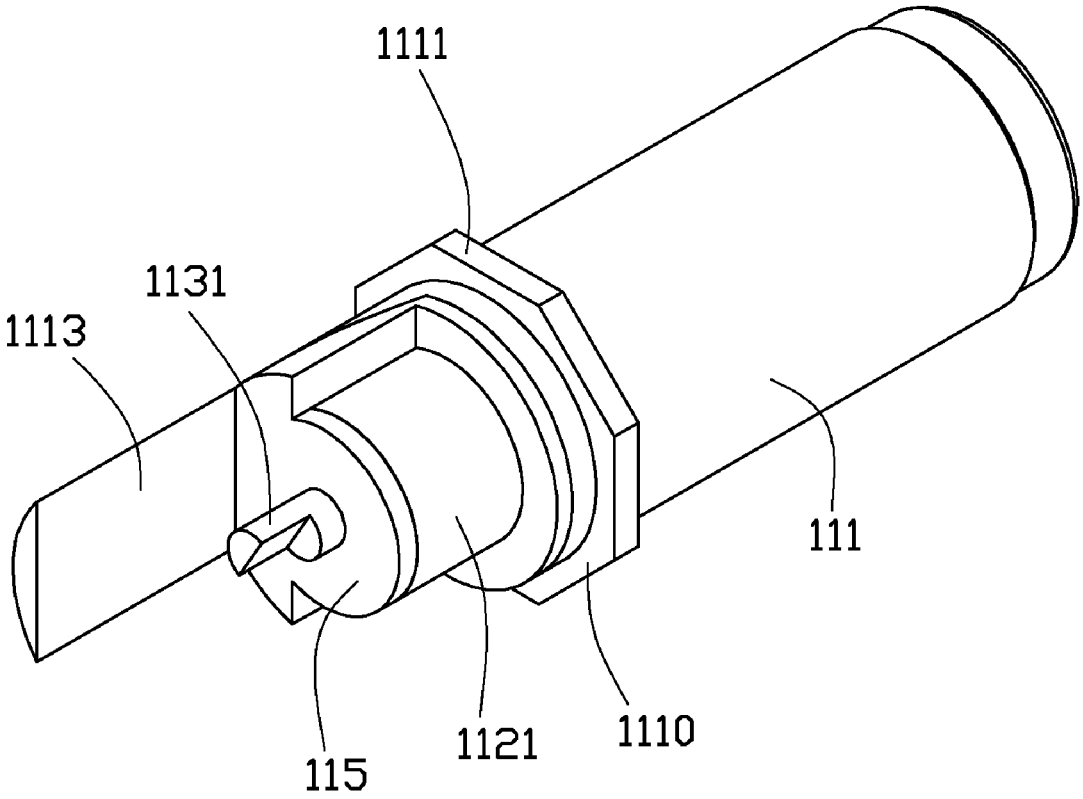
FIG. 2 is an isometric, cut-away view of a terminal module of the cable connector in FIG. 1.
Figure 3:
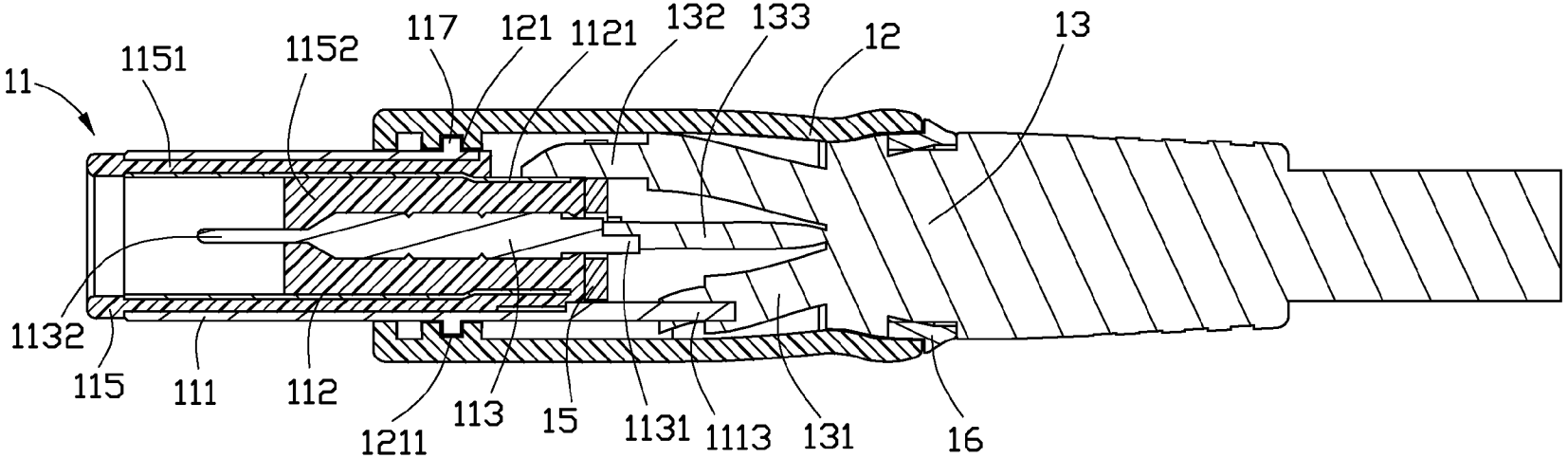
FIG. 3 is a cross-sectional view taken along the line III-III of FIG. 1.

Also referring to FIGS. 2 and 3, the terminal module 11 includes a first terminal 111, a second terminal 112, a third terminal 113, an insulator 115, and a latching flange 117. The latching flange 117 is positioned on an outer surface of the first terminal 111.

The first terminal 111 is substantially cylindrical and elongated along at least a portion of an axis AB. One end of the first terminal 111 forms a first welding portion 1113. The latching flange 117 has one or more portions of its periphery flattened to form a resisting surface 1171. In the illustrated embodiment, there are eight such resisting surfaces 1171 and each two adjacent resisting surfaces 1171 have a same edge, thereby the eight resisting surfaces 1171 are connected to each other and forming an octagonal periphery.

The second terminal 112 is substantially cylindrical and elongated along at least a portion of the axis AB. An end of the second terminal 112 forms a second welding portion 1121. An outer diameter of the second terminal 112 is smaller than an inner diameter of the first terminal 111. The second terminal 112 is positioned in the first terminal 111 in such a manner that the second terminal 112 and the first terminal 111 have the same axis AB, and the second welding portion 1121 is adjacent to the first welding portion 1113 of the first terminal 111.

The third terminal 113 is substantially cylindrical and elongated along at least a portion of the axis AB. A first end of the third terminal 113 forms a third welding portion 1131 and a second end of the third terminal 113 forms a metal pin 1132. An outer diameter of the third terminal 113 is smaller than an inner diameter of the second terminal 112. The third terminal 113 is positioned in such a manner that its axis is also AB, and the third welding portion 1131 is adjacent to the second welding portion 1121 and the first welding portion 1113.

The insulator 115 includes a first insulating portion 1151 and a second insulating portion 1152. The first insulating portion 1151 is positioned between the first terminal 111 and the second terminal 112. The second insulating portion 1152 is positioned between the second terminal 112 and the third terminal 113. As a result, the first, the second, and the third terminals 111, 112, 113 are all electrically insulated from each other. At the same time, the first, the second, the third welding portions 1113, 1121, 1131, and the metal pin 1132 are all exposed out of the insulator 115.

The housing 12 is substantially cylindrical and elongated along at least a portion of the axis AB. An inner surface of the housing 12 defines a latching groove 121. The surface of the latching groove 121 defines eight resisting surfaces 1211 connected to each other. The latching flange 117 is received in the latching groove 121 in such a manner that the resisting surfaces 1171 abut the resisting surfaces 1211 of the latching groove 121, thereby fixing the housing 12 on the outer surface of the first terminal 111.

The cable 13 includes a first core 131, a second core 132, and a third core 133. The first, the second, and the third cores 131, 132, 133 are welded to the first, the second, and the third welding portions 1113, 1121, 1131 respectively.

The cable connector 10 further includes a printed circuit board 15 and an indicator 16. The printed circuit board 15 is positioned on the terminal module 11. The third welding portion 1131 extends though the printed circuit board 15 and is electrically connected to the printed circuit board 15. The indicator 16 is a light emitting diode, in one embodiment, and is positioned on a connecting portion between the housing 12 and the cable 13. The indicator 16 is electrically connected to the third terminal 113 by the third core 133. When the cable connector 10 is in operation and working properly, the third core 133 transmits a control signal to the indicator 16, then the indicator 16 emits light, thereby indicating the cable connector 10 is working.

A method for making the cable connector 10 includes the blocks described in the following paragraphs. It may be understood that depending on the embodiment, additional blocks may be added, others deleted, and the ordering of the blocks may be changed.

First, to fabricate a terminal module 11, the first terminal 111, the second terminal 112, and the third terminal 113 are provided. A periphery of the first terminal 111 forms a latching flange 117. A periphery of the latching flange 117 forms eight resisting surfaces 1171 connected to each other, thereby forming a regular octagon. The first terminal 111, the second terminal 112, and the third terminal 113 have a first, a second, and a third welding portions 1113, 1121, 1131 respectively. The second terminal 112 is placed in the first terminal 111, and the third terminal 113 is placed in the second terminal 112 in such manner that the first, the second, and the third terminals 111, 112, 113 have the same axis. A plastic material is injected into a space defined by the first, the second, and the third terminal 111, 112, 113, thereby forming the insulator 115. The first, the second, and the third terminals 111, 112, 113 are electrically insulated by the insulator 115.

It should be pointed out that, the latching flange 117 can be formed by one of the following means: i) the latching flange 117 is integrally formed with the first terminal 111 by milling; ii) the latching flange 117 and the first terminal 111 are formed separately at first, then the latching flange 117 is fixed on the first terminal 111 by an interference fit process; or iii) the latching flange 117 is integrally formed with the insulator 115 by injection molding. It may be understood that the interference fit process means that the inner diameter of the latching flange 117 is slightly smaller than the outer diameter of the first terminal 111 such that the latching flange 117 can be tightly fitted around the first terminal 111 by special tools.

In the above mentioned methods, the methods ii) and iii) can save raw materials and reduce cost. In addition, when the latching flange 117 is integrally formed with the insulator 115 by injection, a through hole needs to be defined in the first terminal 111 such that molten plastic material is capable of passing through the through hole to form the latching flange 117 on the periphery of the first terminal 111.

The first, the second, and the third terminals 111, 112, 113 are, in one embodiment, made of a conductive metallic material, such as brass. The first, the second, and the third terminals 111, 112, 113 may be formed by methods such as die-casting, extrusion, forging, punching, and so on. In addition, a metallic film may also be formed on an outer surface of the first, the second, and the third terminals 111, 112, 113. The metal film is, in one embodiment, nickel film. A material of the insulator 115 can be polymer such as polyacetal resin (POM).

Secondly, the housing 12 may be fabricated by an injection molding process in one embodiment. An inner surface of the housing 12 forms the latching groove 121, and an inner surface of the latching groove 121 forms eight resisting surfaces 1211 connecting to each other correspondingly. The housing 12 consists of two symmetrical parts. The two symmetrical parts engage with each other to cooperatively define a cavity. Therefore, components such as the terminal module 11 and the cable 13 can be easily fixed in the housing 12.

Thirdly, the cable 13, the printed circuit board 15, and the indicator 16 are provided. The cable 13 includes the first core 131, the second core 132, and the third core 133. The terminal module 11 is mounted in the housing 12 in such a manner that the latching flange 117 is received in the latching groove 121, and the resisting surfaces 1171 of the latching flange 117 resist the resisting surface 1211 of the latching groove 121. The printed circuit board 15 is mounted in the housing 12 and is positioned on the terminal module 11 adjacent to the third welding portion 1131. The third welding portion 1131 extends through the printed circuit board 15 and electrically connected to the printed circuit board 15. The cable 13 is positioned in the housing 12. The first, the second, and the third cores 131, 132, 133 are welded to the first, the second, and the third welding portions 1113, 1121, 1131 of the terminal module 11 respectively. The indicator 16 is positioned in the housing 12 and electrically connected to the cable 13. Pins (not shown) of the indicator 16 are electrically connected to the third core 133. Finally, two symmetrical parts of the housing 12 are combined by a method of pasting or latching. The latching flange 117 is received in the latching groove 121 of the housing 12 in such manner that the resisting surfaces 1211 of the latching groove 121 abut the resisting surfaces 1171 of the latching flange 117.

When the terminal module 11 is positioned in the housing 12, the latching flange 117 engages in the latching groove 121. As a result, the terminal module 11 is fixed in the housing 12. In addition, the latching flange 117 is tightly latched in the latching groove 121 to prevent the terminal module 11 from detaching from the housing. Furthermore, at least one resisting surface 1211 of the latching groove 121 abuts the latching flange 117 for preventing the terminal module 11 from rotating, thereby preventing damage to the cable connector 10.

It can be understood that, a filling plastic can be filled into a space defined by the housing 12, the terminal module 11, the printed circuit board 15, and the cable 13. The filling plastic can fix the first, the second, and the third cores 131, 132, 133 on the housing 12 and protect the welding portion and the printed circuit board 15. The number of the resisting surfaces 1171 of the latching flange 117 can be fewer than or more than 8, for example 4, 6 or 10. In addition, other configurations such as a protrusion or a depression having at least one resisting surface, which can fix the terminal module 11 on the housing 12, can be applied to the terminal module 11 and the housing 12. The first, the second terminals 111, 112, and the housing 12 can also be some other shape, such as a cuboid, barrel shaped, or tubular.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A method for making a terminal module configured for engaging in a housing of a cable connector, the method comprising:

providing a first terminal and a second terminal positioned in the first terminal;

forming an insulator between the first terminal and the second terminal; and forming a latching flange on an outer surface of the first terminal, wherein the housing defining a latching groove for receiving the first terminal, and the latching groove forming a plurality of flat resisting surfaces radially arranged and connected to each other, and the latching flange has a plurality of portions of its periphery flattened to form a plurality of flat resisting surfaces abutting the flat resisting surfaces of the latching groove, thereby fixing the housing on the outer surface of the first terminal.

2. The method for making a terminal module as claimed in claim 1, wherein the latching flange is integrally formed with the first terminal by milling.

3. The method for making a terminal module as claimed in claim 1, wherein the latching flange and the first terminal are formed separately at first, then the latching flange is fixed on the first terminal by an interference fit process.

4. The method for making a terminal module as claimed in claim 1, wherein the latching flange is integrally formed with the insulator by an injection molding process.

5. The method for making a terminal module as claimed in claim 4, wherein a through hole is defined in the first terminal such that a molten plastic material is capable of passing through the through hole to form the latching flange on the outer surface of the first terminal.

* * * * *